US005785562A

United States Patent [19]

Nestvall

[11] Patent Number: 5,785,562

[45] Date of Patent: Jul. 28, 1998

[54] METHOD FOR TRIMMING OF A BOAT PROPELLER DRIVE AND DRIVE UNIT WITH MEANS FOR PERFORMING THE METHOD

[75] Inventor: Per Nestvall, Mölndal, Sweden

[73] Assignee: AB Volvo Penta, Gothenburg, Sweden

[21] Appl. No.: 790,456

[22] Filed: Jan. 29, 1997

[30] Foreign Application Priority Data

Jan. 29, 1996 [SE] Sweden ..... 9600305

[51] Int. Cl.[6] ..... B63H 21/22

[52] U.S. Cl. ..... 440/1; 701/123

[58] Field of Search ..... 440/1, 2, 53, 61–63, 440/113, 900; 364/442; 701/123

[56] References Cited

U.S. PATENT DOCUMENTS 3,972,224 8/1976 Ingram ..... 364/442

4,939,660 7/1990 Newman et al. .

5,073,133 12/1991 Inoue .

FOREIGN PATENT DOCUMENTS 4 214 305 11/1992 Germany .

*Primary Examiner*—Ed L. Swinehart

*Attorney, Agent, or Firm*—Young & Thompson

[57] ABSTRACT

Drive unit for boats comprising an internal combustion engine (16) and an outboard drive (1) driven by the engine. The engine has an engine control unit (13) which holds the speed of the engine constant independently of the load on the engine. A flowmeter (15) continuously gives a signal, which represents the instantaneous fuel consumption to the engine control unit. A trim control unit (11) controls the trim angle of the drive so that the lowest fuel consumption for the set engine speed is achieved.

3 Claims, 1 Drawing Sheet

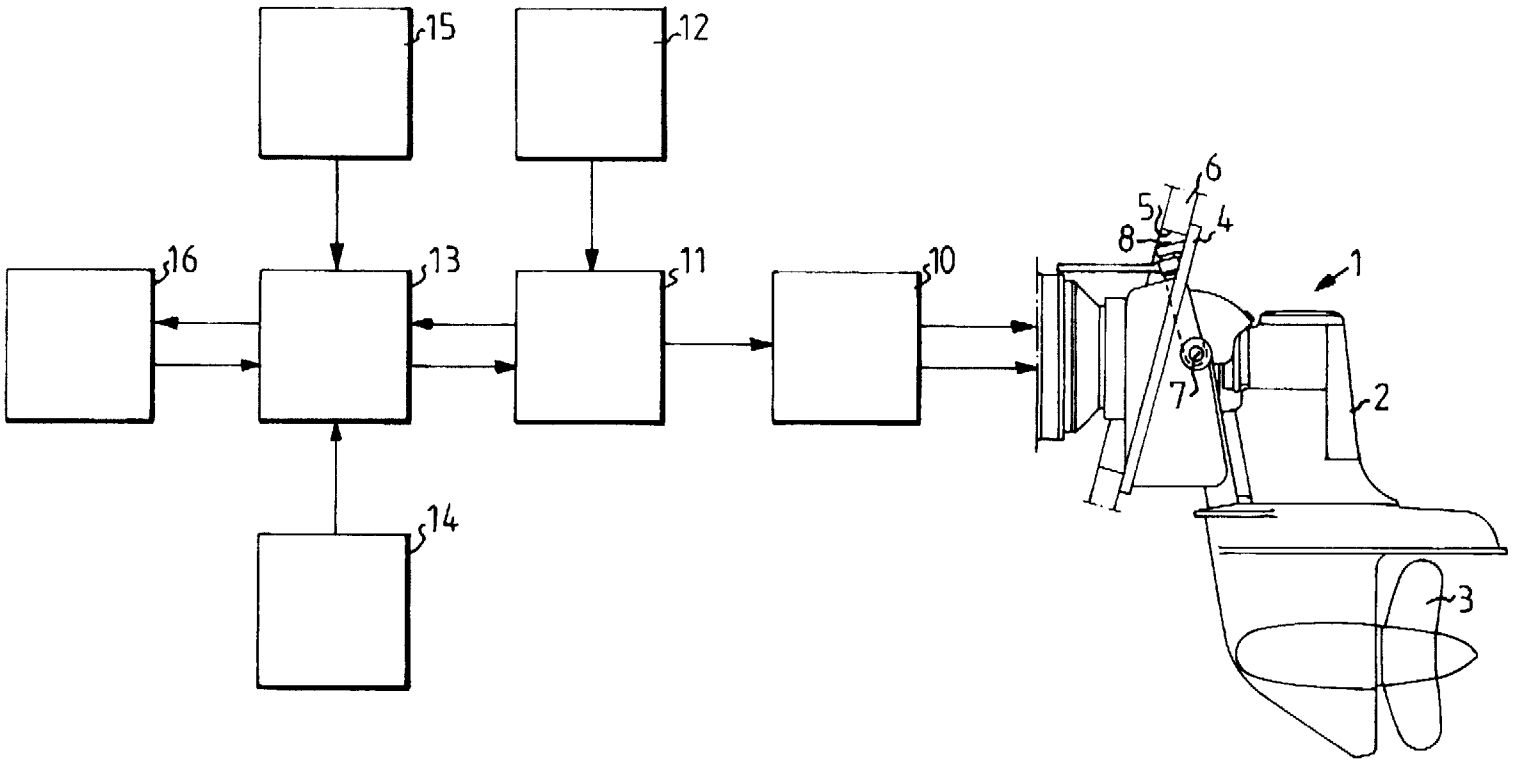
1
2
3
4
5
6
7
8
10
11
12
13
14
15
16

METHOD FOR TRIMMING OF A BOAT PROPELLER DRIVE AND DRIVE UNIT WITH MEANS FOR PERFORMING THE METHOD

FIELD OF THE INVENTION

The present invention relates to a method for setting the trim angle on a boat propeller drive which is mounted in bearings for rotation around a horizontal trim axis and is drivably coupled to an engine with an engine control unit, which, independently of the load on the motor, holds the engine speed constant at the number of revolutions set by the throttle lever.

The invention also relates to a drive unit for boats comprising, on the one hand, an internal combustion engine with an engine control unit connected to a throttle lever which is arranged to control the fuel/air mixture of the engine so that the engine speed set by means of the throttle lever is held constant independently of the load on the engine, and, on the other hand, a propeller drive drivably connected to the engine which has control means for rotating the propeller drive around a horizontal trim axis.

BACKGROUND OF THE INVENTION

It is a known fact that the trim angle of a boat propeller drive, i.e. the angle it makes against the stern of the boat, has a great influence when it is a question of optimizing the fuel consumption against the speed of the boat. In general it is valid that the drive is trimmed away from the stern at high speeds and in towards the stern at low speeds. Different solutions for automatic trimming of the propeller drive are known. In a simple regulation system without feedback, trim angles related to the speed of the boat are predetermined with reference to the type of the boat. In a known regulation system with feedback an increase in speed of the boat is sensed and the drive is trimmed until the increase in speed stops. This continues so that the drive is trimmed in steps in one direction as long as the movement results in an increase of speed and subsequently in the opposite direction so long as this results in an increase in speed. The regulating system consequently oscillates the drive backwards and forwards in both directions until the maximum boat speed with reference to the throttle opening is achieved.

Another system for optimizing the drive of a boat by, via the trimming angle of the drive, balancing the fuel consumption of the boat against the speed of the boat, is known (U.S. Pat. No. 4,939,660). Here a comparison between the engine speed and the speed of the boat is used to set the drive with the trim angle which gives the highest engine speed with an unchanged throttle opening, which then gives the lowest fuel consumption for the speed achieved. This can however, mean that the speed of the boat is higher than that which is desired, which means that the throttle opening must be reduced. This causes the engine speed to drop, the speed is reduced and the regulation system must again trim the drive to the position which gives the highest engine speed and thereby the highest speed with the new throttle position. Consequently, the setting of a predetermined speed of the boat which gives the lowest fuel consumption requires a certain hunting with the throttle opening.

Engines with electronic control units which hold the engine speed constant at a speed set by means of a throttle lever independently of the load on the engine, are known.

SUMMARY OF THE INVENTION

The object of the present invention is, with a boat propeller drive driven by such an engine, to bring about a method of optimizing the fuel consumption through trimming of the drive without the speed of the boat being influenced.

This is achieved according to the invention through the instantaneous fuel consumption of the engine being continuously measured and the drive being set with a trim angle which gives the lowest value of the fuel consumption at the set engine speed. The principal differences between the method known from U.S. 4,939,660 for controlling the trim angle, and the method according to the invention is that the former uses the speed of the boat and/or the engine speed in order to achieve the optimal fuel consumption while the latter uses the fuel consumption directly instead of indirectly through using the speed or engine speed.

A drive unit for boats of the type mentioned in the preamble is characterized according to the invention by the engine control unit being connected to means for measuring the instantaneous fuel consumption of the engine and to a trim control unit for controlling said manoeuvering means, and that the engine control unit is arranged, while holding the engine speed constant through regulation of the fuel/air mixture, to give a signal to said trim control unit to, via the maneuvering means, set the propeller drive with a trim angle which corresponds to the lowest measured fuel consumption for the set engine speed.

BRIEF DESCRIPTION OF THE DRAWING

The invention is described in more detail with reference to the appended drawing showing an example of an embodiment where the figure schematically shows an engine and propeller drive installation according to the invention.

In the FIG., 1 refers generally to a propeller drive for boats. The drive can be of the type which is marketed under the name Aquamatic® and which comprises a propeller rig 2 containing (not shown) drive axles, reversing gear and propeller shaft for a propeller 3. The rig 2 is suspended in an escutcheon 4, which is mounted over an opening 5 in the stern 6 of a boat. The rig 2 is mounted in bearings for rotation, on the one hand, around a transverse horizontal trim and tipping axis 7 and, on the other hand, around a control axis 8 lying in a vertical plane.

Between the rig 2 and the escutcheon 4, a power-driven trim operating means 10 is working, which can comprise an oil pump and a pair of hydraulic cylinders. The trim and manoeuvering means 10 is controlled by an electronic trim control unit 11 which can comprise a microprocessor and which is arranged to set the trim angle of the rig 2, depending on a signal either from a manual trim regulator 12 or from a motor control unit 13, in which a signal representing a desired set value for the engine speed set by a manual throttle lever 14 is inputted and a signal representing the instantaneous fuel consumption, which is taken from a flowmeter 15. An engine speed measurer on the engine 16 inputs a signal representing the actual value of the engine speed. If the throttle opening is changed via the throttle lever 14, the motor control unit 13 will change the fuel/air mixture supply to the engine so that its speed is changed to the new speed. At the same time the motor control unit 13 sends a signal to the trim control unit 11 to change the angle of the rig 2 against the stem 4 of the boat by means of the trim manoeuvering means 10. If the change of engine speed causes an increase in the engine speed, the rig 2 is trimmed out from the stern. The signal representing the change of the trim angle is inputted into the engine control unit 13 and compared to a signal from the flowmeter 15 representing the instantaneous fuel consumption. A trim angle change, which leads to the load on the engine decreasing, results in the engine control unit 13 reducing the throttle position in order to retain the actual value of the engine speed at the set desired value. The consequence is that the fuel consumption is reduced. The trim control unit 11 then locks the rig 2 at the trim angle at which the lowest instantaneous fuel consumption is measured.

The motor control function and the trim control function above have been related to two different units 11 and 13, but these functions can naturally within the scope of the invention be integrated into one and the same control unit.

I claim:

1. In a method of setting the trim angle of a boat propeller drive, which is mounted in bearings for rotation around a horizontal trim axis and which is drivably connected to an engine with an engine control unit, which holds the engine speed constant at a set speed determined by means of a throttle opening independently of the load on the engine, the improvement which comprises: continually measuring the instantaneous fuel consumption of the engine, and setting the trim angle of the propeller drive at an angle which gives the lowest value of fuel consumption at the set engine speed.

2. In a drive unit for boats, comprising an internal combustion engine with an engine control unit connected to a throttle lever, which engine control unit is arranged to hold constant the engine speed set by the throttle lever independently of the load on the engine, a propeller drive drivingly connected to the engine, and manoeuvering means for rotating the propeller drive around a horizontal trim axis, the improvement wherein the engine control unit is connected to means for measuring the instantaneous fuel consumption of the engine, and to a trim control unit for controlling said manoeuvering means, said engine control unit including means, while holding the engine speed constant, to give signals to said trim control unit to position the propeller drive, via the manoeuvering means, at a trim angle which corresponds to the lowest measured fuel consumption for the set engine speed.

3. The drive unit according to claim 2, wherein the means for measuring the instantaneous fuel consumption of the engine include a flow meter.

* * * * *